US008474439B2

(12) United States Patent
Makino et al.

(10) Patent No.: US 8,474,439 B2
(45) Date of Patent: Jul. 2, 2013

(54) FUEL VAPOR PROCESSORS

(75) Inventors: Katsuhiko Makino, Aichi-ken (JP); Junya Kimoto, Obu (JP); Masanobu Shinagawa, Aichi-ken (JP); Takashi Mani, Hekinan (JP); Masakazu Hasegawa, Miyohi (JP)

(73) Assignee: Aisan Kogyo Kabushiki Kaisha, Aichi-Ken (JP)

( * ) Notice: Subject to any disclaimer, the term of this patent is extended or adjusted under 35 U.S.C. 154(b) by 629 days.

(21) Appl. No.: 12/772,272

(22) Filed: May 3, 2010

(65) Prior Publication Data

US 2010/0294251 A1 Nov. 25, 2010

(30) Foreign Application Priority Data

May 21, 2009 (JP) ..... 2009-122921
Jan. 12, 2010 (JP) ..... 2010-003795

(51) Int. Cl.
*F02M 37/20* (2006.01)
*F02M 33/02* (2006.01)

(52) U.S. Cl.
USPC ..... 123/516; 123/514; 123/520

(58) Field of Classification Search
USPC ..... 123/514, 516, 518, 519, 520
See application file for complete search history.

(56) References Cited

U.S. PATENT DOCUMENTS 4,191,154 A * 3/1980 Shibata ..... 123/519
6,067,967 A * 5/2000 Kidokoro et al. ..... 123/516
6,786,207 B2 * 9/2004 Kojima et al. ..... 123/516
(Continued)

FOREIGN PATENT DOCUMENTS

JP 01-130065 5/1989
JP 09-168716 6/1997
(Continued)

OTHER PUBLICATIONS

Japanese Office Action mailed May 21, 2013, corresponding to Japanese Patent Application No. 2010-003795 with English language translation.

*Primary Examiner* — Thomas Moulis
(74) *Attorney, Agent, or Firm* — Ladas & Parry LLP

(57) ABSTRACT

A fuel vapor processor has a fuel tank, a canister, a recovery pipe, a fuel pump, a negative pressure generator, a pressure regulator, a fuel intake pipe and a fuel intake regulator. The vapor pipe leads the fuel vapor generated in the fuel tank into the canister for trapping the fuel vapor. The recovery pipe connects the fuel tank and the canister for recovering the fuel vapor trapped in the canister into the fuel tank. The fuel intake pipe directly connects the fuel pump provided in the fuel tank with the negative pressure generator for leading fuel to the negative pressure generator. The negative pressure generator generates negative pressure depending on an amount of fuel supplied to the negative pressure generator from the fuel pump. The fuel vapor trapped in the canister is recovered to the fuel tank through the recovery pipe due to the negative pressure. The pressure regulator is connected with the fuel pump for returning excess fuel discharged from the fuel pump into the fuel tank. The fuel intake regulator disposed on the fuel intake pipe controls the amount of the fuel supplied to the negative pressure generator from the fuel pump.

8 Claims, 10 Drawing Sheets

U.S. PATENT DOCUMENTS

| | | | | |
|---|---|---|---|---|
| 7,077,112 | B2 * | 7/2006 | Mitani et al. | 123/518 |
| 7,380,543 | B2 * | 6/2008 | Hatano et al. | 123/519 |
| 7,484,500 | B2 * | 2/2009 | Terada | 123/516 |
| 7,694,665 | B2 * | 4/2010 | Ehrman et al. | 123/518 |
| 8,327,830 | B2 * | 12/2012 | Makino et al. | 123/518 |
| 2003/0205272 | A1 * | 11/2003 | Benjey et al. | 137/202 |
| 2010/0288241 | A1 * | 11/2010 | Makino et al. | 123/521 |
| 2011/0186020 | A1 * | 8/2011 | Makino | 123/521 |
| 2011/0214646 | A1 * | 9/2011 | Makino | 123/518 |
| 2011/0247595 | A1 * | 10/2011 | Ogita et al. | 123/521 |
| 2012/0085325 | A1 * | 4/2012 | Makino et al. | 123/521 |

FOREIGN PATENT DOCUMENTS

| | | |
|---|---|---|
| JP | 2001068738 | 3/2001 |
| JP | 2002-235608 | 8/2002 |
| JP | 2002235608 | 8/2002 |
| JP | 2004144043 | 5/2004 |
| JP | 2006250000 | 9/2006 |
| JP | 2007040193 | 2/2007 |
| JP | 2009122921 | 6/2009 |

* cited by examiner

FUEL VAPOR PROCESSORS

CROSS-REFERENCES TO RELATED APPLICATIONS

This application claims priority to Japanese patent applications serial number 2009-122921 and 2010-003795, the contents of which are incorporated herein by reference.

BACKGROUND OF THE INVENTION

1. Field of the Invention

The present invention relates to devices for treating fuel vapor, in particular, fuel vapor processors having a canister for trapping fuel vapor (e.g., gasoline vapor), a vapor pipe for leading the fuel vapor from a fuel tank to the canister, a recovery pipe for recovering the fuel vapor trapped in the canister to the fuel tank, a negative pressure generator for generating negative pressure depending on an amount of fuel supplied to the negative pressure generator from a fuel pump disposed in the fuel tank, and a pressure regulator for returning excess fuel discharged from the fuel pump into the fuel tank, the fuel vapor trapped in the canister being recovered into the fuel tank through the recovery pipe due to the negative pressure.

2. Description of the Related Art

Japanese Laid-Open Patent Publication No. 2002-235608 discloses a fuel vapor processor having a negative pressure generator fluidly communicating with a fuel pump via a pressure regulator. When the fuel pump is running, e.g., during driving, excess fuel discharged from the fuel pump is returned into the fuel tank via the pressure regulator. In this case, the fuel returned from the pressure regulator is led into the negative pressure generator in order to generate negative pressure. This negative pressure generator is provided at the middle of the recovery pipe. And, an open end of the recovery pipe, i.e., an outlet for the fuel vapor recovered from the canister, is submerged in a fuel reserved in the fuel tank. Neither the recovery pipe nor the vapor pipe are equipped with any switching device capable of changing between open and closed states, so that as far as the fuel pump is running and the excess fuel is returned, the fuel vapor processor continuously recovers the fuel vapor.

With respect to such fuel vapor processor, because the negative pressure generator is indirectly communicated with the fuel pump via the pressure regulator, strength of the negative pressure depends on an amount of the excess fuel returned by the pressure regulator. Hence, the strength of the negative pressure varies regardless of a condition of the canister, so that a capability of recovering the fuel vapor is unstable. For example, in a case that a discharge amount from the pump is fixed, when fuel consumption by an engine is high and the return amount by the pressure regulator is low, the strength of the negative pressure is low, so that the capability of recovering the fuel vapor is low. On the other hand, when the fuel consumption by the engine is low and the return amount by the pressure regulator is high, the strength of the negative pressure is high, so that the capability of recovering the fuel vapor is high.

In addition, with respect to the fuel vapor processor, as far as the fuel pump is running and the excess fuel is returned, the fuel vapor is continuously recovered regardless of the amount of the fuel vapor in the canister. Thus, there is a need for improved fuel vapor processors.

Inventors of this application have found that the above-described problem could be solved by direct connection between the negative pressure generator and the fuel pump without the pressure regulator. However, if such direct connection between the negative pressure generator and the fuel pump is applied to the fuel vapor processor disclosed in Japanese Laid-Open Patent Publication No. 2002-235608, another problem occurs. In particular, in a such case that the negative pressure generator and the fuel pump are directly communicated with each other, when the amount of the fuel discharged from the fuel pump is fixed, an amount of the fuel led into the negative pressure generator becomes constant as shown in FIG. 1, so that the strength of the negative pressure is also fixed. Here, a fuel requirement by the engine equals an amount of the fuel supplied to the engine. In this case, the largest amount of the fuel supplied to the engine decreases by the fuel led into the negative pressure generator. If a total amount of the fuel requirement by the engine and the fuel led into the negative pressure generator is lower than a maximum amount of the fuel discharged from the fuel pump, there is no problem. However, when the total amount is larger than the maximum amount of the fuel discharged from the fuel pump as shown by a shaded area in FIG. 1, fuel supplied to the engine would run short.

SUMMARY OF THE INVENTION

An improved fuel vapor processor can include a fuel tank, a canister, a vapor pipe, a recovery pipe, a fuel pump, a negative pressure generator, a pressure regulator, a fuel intake pipe, and a fuel intake regulator. The vapor pipe leads the fuel vapor generated in the fuel tank into the canister for trapping the fuel vapor therein. The recovery pipe connects the fuel tank and the canister for recovering the fuel vapor trapped in the canister into the fuel tank. The fuel intake pipe directly connects the fuel pump provided in the fuel tank with the negative pressure generator for leading fuel to the negative pressure generator. The negative pressure generator generates negative pressure depending on an amount of fuel supplied to the negative pressure generator from the fuel pump. The fuel vapor trapped in the canister is recovered to the fuel tank through the recovery pipe due to the negative pressure. The pressure regulator is connected with the fuel pump for returning excess fuel discharged from the fuel pump into the fuel tank. The fuel intake regulator disposed on the fuel intake pipe controls the amount of the fuel supplied to the negative pressure generator from the fuel pump. The negative pressure generator can be disposed on either the middle of the recovery pipe or an end of the recovery pipe.

In accordance with this aspect, the negative pressure generator is directly connected with the fuel pump, so that it is able to stably generate the negative pressure not depending on the amount of the fuel returned from the pressure regulator. In addition, the fuel intake regulator adequately controls the amount of the fuel supplied to the negative pressure generator from the fuel pump depending on various circumferences.

The fuel vapor processor can further include an aspirator as the negative pressure generator having a fuel intake port, a nozzle portion, a suction port, a diffuser portion and a needle valve. The fuel discharged from the fuel pump is led into the fuel intake port. The fuel led into the fuel intake port is injected from the nozzle portion. The fuel vapor is suctioned via the suction port due to injection of the fuel from the nozzle portion. The fuel injected from the nozzle portion and the fuel vapor suctioned through the suction port are mixed in an inner space of the diffuser portion. The needle valve is movable in an axial direction of the aspirator and is capable of adjusting the amount of the fuel injected from the nozzle portion depending on a position of the needle valve.

In accordance with this aspect, an opening ratio of the nozzle portion can be changed by displacement of the needle valve in order to control the amount of the fuel injected from the nozzle portion and therefore a suction capability of the aspirator.

DETAILED DESCRIPTION OF THE PREFERRED EMBODIMENTS

Each of the additional features and teachings disclosed above and below may be utilized separately or in conjunction with other features and teachings to provide improved fuel vapor processors. Representative examples, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

Figure 1:
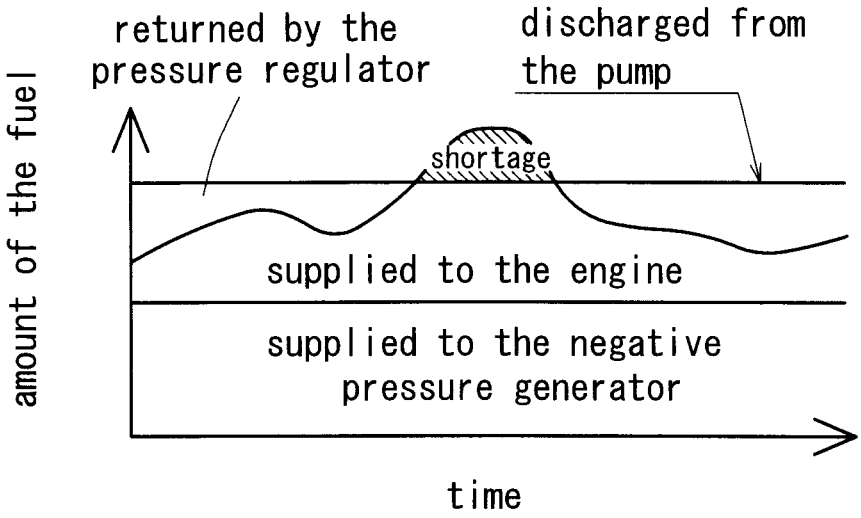
FIG. 1 is a chart showing one example of fuel supply in the hypothetical fuel vapor processor.
Figure 2:
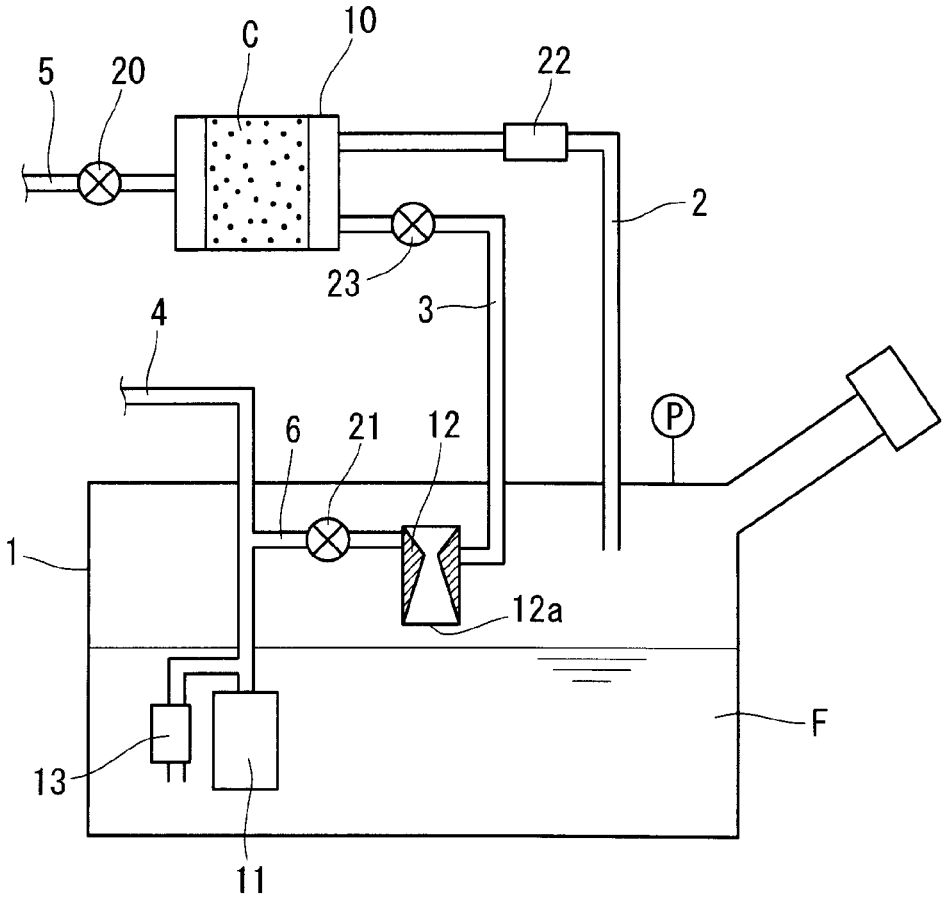
FIG. 2 is a schematic view showing the fuel vapor processor.

FIG. 2 shows a fuel vapor processor that can include a canister 10 for trapping fuel vapor (for example, gasoline vapor) generated in a fuel tank 1, a vapor pipe 2 for leading the fuel vapor generated in the fuel tank 1 into the canister 10, a recovery pipe 3 for recovering the fuel vapor trapped in the canister 10 into the fuel tank 1, and an aspirator 12 for generating negative pressure by utilizing some of fuel discharged from a fuel pump 11. The aspirator 12 corresponds to the negative pressure generator of the present teaching.

The fuel tank 1 is a sealed reservoir in which fuel F is retained. The fuel pump 11 is disposed in the fuel tank 1 and is submerged in the fuel F. The fuel pump 11 can pump the fuel F from the fuel tank 1 to an engine (not shown) through a fuel supply pipe 4. In addition, the fuel pump 11 is fluidly communicated with a pressure regulator 13 for returning excess fuel into the fuel tank. Here, the excess fuel is fuel discharged from the fuel pump 11 over a fuel requirement of the engine. The fuel tank 1 is equipped with a pressure sensor P for detecting inner pressure in the fuel tank 1. Signals detected by the pressure sensor P are transmitted to an engine control unit (ECU) (not shown).

The canister 10 is a sealed container and is filled with an adsorbent C made of activated carbon or the like, which can adsorb and desorb the fuel vapor. The fuel vapor led into the canister 10 adsorbs onto the adsorbent C, whereas the contents of air do not adsorb on the adsorbent C. Furthermore, the canister 10 is connected with an air pipe 5 opening to the atmosphere. The air pipe 5 is equipped with an air pipe valve 20, which is a solenoid valve controlled by the ECU.

Figure 3:
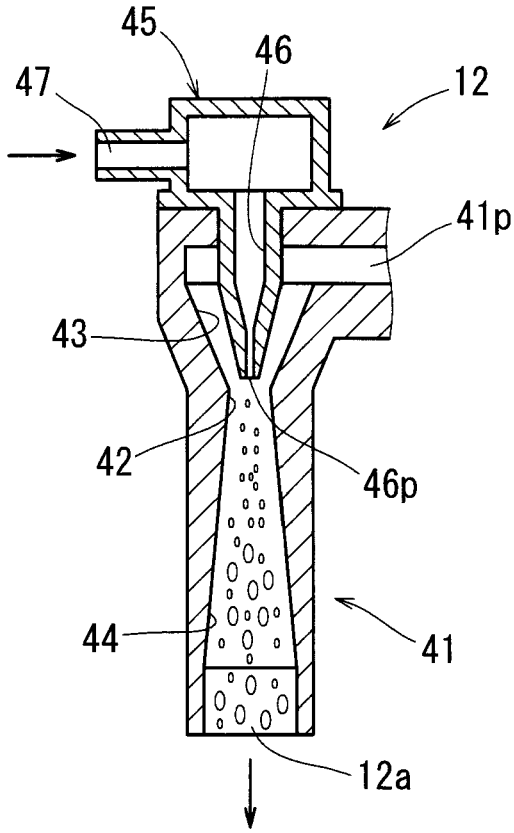
FIG. 3 is a longitudinal cross-sectional view of the aspirator.

The aspirator 12 is positioned at an end of the recovery pipe 3 and generates negative pressure such that negative pressure acts on the canister 10 via the recovery pipe 3 in order to recover the fuel vapor trapped in the canister 10. The aspirator 12 is connected with a fuel intake pipe 6 branched from the fuel supply pipe 4, so that some of the fuel F discharged from the fuel pump 11 is led into the aspirator 12 through the fuel intake pipe 6. That is, the aspirator 12 is directly connected with the fuel pump 11 via the fuel intake pipe 6 independently from the pressure regulator 13. The aspirator 12 is composed of a venturi housing 41 and a nozzle housing 45 as shown in FIG. 3. The venturi housing 41 has a narrowed part 42, an entry part 43 disposed above the narrowed part 42 and decreasing its inner diameter along a fuel flowing direction, and an exit part 44 disposed below the narrowed part 42 and increasing its inner diameter along the fuel flowing direction. The entry part 43, the narrowed part 42 and the exit part 44 are positioned concentrically. An upper end of the entry part 43 of the venturi housing 41 is provided with a suction port 41*p* connected with the recovery pipe 3. Whereas, the nozzle housing 45 has a nozzle body 46 concentrically disposed inside the entry part 43 of the venturi housing 41 such that a nozzle orifice 46*p* of the nozzle body 46 is positioned near the narrowed part 42 of the venturi housing 41. In addition, a base part of the nozzle body 46 (opposite side to the nozzle orifice 46*p*) is provided with a fuel intake port 47 connected with the fuel intake pipe 6.

Some of the fuel F pumped by the fuel pump 11 toward the engine through the fuel supply pipe 4 is led into the aspirator 12 through the fuel intake pipe 6 and fuel intake port 47. The nozzle orifice 46*p* of the nozzle body 46 produces a jet of the led fuel F, so that the fuel F moves through the narrowed part 42 and the exit part 44 of the venturi housing 41 along the axial direction. As a result, negative pressure is generated near the narrowed part 42 of the venturi housing 41 and acts on the canister 10 via the recovery pipe 3 communicated with the suction port 41*p*. The fuel vapor trapped in the canister 10 is desorbed (purged) due to action of the negative pressure. The fuel vapor recovered from the canister 10 is discharged through a discharge opening 12*a* together with the fuel injected from the nozzle body 46. That is, in this embodiment, the discharge opening 12*a* of the aspirator 12 is an outlet for the fuel vapor recovered from the canister 10.

As shown in FIG. 2, the aspirator 12 is disposed in a gas space in the fuel tank 1 (above a fluid level of the fuel F), and the discharge opening 12*a* is directed downwardly. The fuel intake pipe 6 is equipped with a fuel intake valve 21 as a fuel intake regulator for controlling an amount of the fuel F led into the aspirator 12 from the fuel pump 11. The fuel intake valve 21 is composed of a solenoid valve controlled by the ECU. The vapor pipe 2 is equipped with a pressure control valve 22 for regulating inner pressure in the fuel tank 1. The pressure control valve 22 is a bi-directional check valve including a positive pressure valve and a negative pressure valve. The pressure control valve 22 is closed in a normal state. When the inner pressure in the fuel tank 1 is higher than a predetermined value, the positive pressure valve is opened. On the other hand, when the inner pressure in the fuel tank 1 is lower than a predetermined value, the negative pressure valve is opened. A setting pressure for the pressure control valve 22 is decided so as to prevent breakage of the fuel tank 1, hence, for example, the setting pressure is set at about ±5 kPa. In this case, the inner pressure of the fuel tank 1 is controlled to be within a range between −5 kPa and +5 kPa. The recovery pipe 3 is equipped with a recovery pipe valve 23 as an opening and closing device for switching between an open state and a closed state of the recovery pipe 3. The recovery pipe valve 23 is composed of a solenoid valve controlled by the ECU.

Next, a treating mechanism by the fuel vapor processor having the above-described components will be described. An air pipe valve 20 disposed on the air pipe 5 is open in a normal state (off condition) and is closed due to power distribution by ECU control (on condition). On the other hand, the recovery pipe valve 23 on the recovery pipe 3 is closed in the normal state (off condition) and is opened due to the power distribution by the ECU control (on condition). In a state that the fuel pump 11 is not running, e.g., during parking or refueling, when the inner pressure in the fuel tank 1 is higher than the setting pressure for the pressure control valve 22 due to generation of fuel vapor, the positive pressure valve of the pressure control valve 22 is opened, so that gas (air and fuel vapor) in the fuel tank 1 flows into the canister 10 through the vapor pipe 2. Then, the adsorbent C in the canister 10 selectively adsorbs the fuel vapor. Remaining air passes through the canister 10 filled with the adsorbent C and flows into the atmosphere through the air pipe 5, so that the inner pressure of the fuel tank 1 decreases. Therefore, drastic increase of the inner pressure in the fuel tank 1 can be inhibited, thereby preventing breakage of the fuel tank 1. When the inner pressure of the fuel tank 1 is within a range of the setting pressure for the pressure control valve 22, the pressure control valve 22 is closed, so that the fuel tank 1 is hermetically closed. On the other hand, when the inner pressure of the fuel tank 1 is lower than the setting pressure for the pressure control valve 22 due to temperature decrease, the negative pressure valve of the pressure control valve 22 is opened, so that ambient air flows through air pipe 5, the canister 10, the vapor pipe 2 and then into the fuel tank 1. Therefore, drastic decrease of the inner pressure of the fuel tank 1 is inhibited, thereby preventing breakage of the fuel tank 1.

While the fuel pump 11 is running, e.g., during driving, the air pipe valve 20 is usually closed, and the recovery pipe valve 23 is opened. Some of the fuel F discharged from the fuel pump 11 is led to the aspirator 12 through the fuel intake pipe 6 branched from the fuel supply pipe 4. Hence, the aspirator 12 generates negative pressure, so that the fuel vapor trapped in the canister 10 is removed and recovered through the recovery pipe 3 due to action of the negative pressure, and then is discharged from the discharge opening 12*a* of the aspirator 12 into the fuel tank 1. In this state, when the inner pressure of the fuel tank 1 becomes higher than the setting pressure for the pressure control valve 22 due to recovery of the fuel or generation of the fuel vapor, the fuel vapor and the like in the fuel tank 1 flow into the canister 10 through the vapor pipe 2 as is the case with parking. In this way, the air pipe valve 20 on the air pipe 5 is usually closed during normal recovery operation for the fuel vapor, so that inflow of the ambient air into the fuel tank 1 is inhibited, thereby preventing drastic increase of the pressure in the fuel tank 1.

However, if a large amount of the fuel vapor is generated due to a high ambient temperature or a high fuel temperature due to heat emitted from the engine or the fuel pump 11, the inner pressure of the fuel tank 1 could drastically increase. In this case, when a pressure detected by the pressure sensor P reaches a predetermined value, the air pipe valve 20 is opened and the recovery pipe valve 23 is closed such that the gas in the fuel tank 1 flows through the canister 10. Thus, drastic increase of the pressure in the fuel tank 1 is prevented. When the detected pressure by the pressure sensor P decreases below the predetermined value due to reduction of the pressure in the fuel tank 1, the air pipe valve 20 is closed again and the recovery pipe valve 23 is opened. In this way, because the recovery pipe valve 23 is provided on the recovery pipe 3, it is able to control feeding the fuel vapor to the aspirator 12 regardless of actions of the aspirator 12 associated with running of the fuel pump 11. Therefore, the vapor processor of this embodiment can adequately operate depending on the pressure in the fuel tank 1 or the like.

Figure 4:
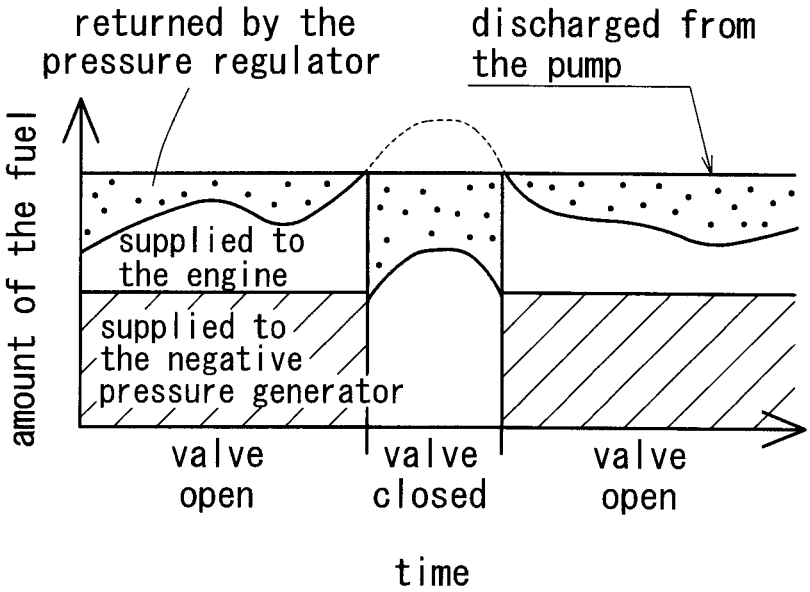
FIG. 4 is a chart showing one example of fuel supply to the aspirator.

The amount of the fuel led into the aspirator 12 from the fuel pump 11 is controlled due to working of the fuel intake valve 21 disposed on the fuel intake pipe 6. One example of control for the amount of the fuel by the fuel intake valve 21 will be described. The fuel intake valve 21 is closed in a normal state (off condition) and is opened due to the power distribution by the ECU (on condition). When meeting requirements for vapor recovery, the fuel intake pipe 21 is opened, and then the fuel discharged from the fuel pump 11 is supplied to the engine, the aspirator 12 and the pressure regulator 13, respectively. That is, as shown in FIG. 4, the amount of the fuel discharged from the fuel pump 11 is equal to a total amount of the fuel supplied to the aspirator 12, the fuel supplied to the engine (the fuel requirement by the engine) and the fuel returned by the pressure regulator 13. In a state that a certain amount of the fuel is discharged from the fuel pump 11, when the fuel intake valve 21 is opened completely, the amount of the fuel supplied to the aspirator 12 becomes maximum. Thus, a maximum amount of the fuel, which can be supplied to the engine, decreases. For example, in a normal driving state, where a total amount of the fuel requirement by the engine and the fuel led into the aspirator 12 is lower than the amount of the fuel discharged from the fuel pump 11, it is able to control the amount of the fuel supplied to the engine within such range, so that the fuel intake valve 21 is open. On the other hand, for example in a state that an accelerator is pressed down, when the total amount of the fuel requirement by the engine and the fuel supplied to the aspirator 12 is higher than the amount of the fuel discharged by the fuel pump 11 as shown by a dot-line in FIG. 4, the fuel intake valve 21 is closed. Thus, the maximum amount of the fuel, which can be supplied to the engine, increases, thereby avoiding a shortage of the fuel supplied to the engine. After that, when the total amount of the fuel requirement by the engine and the fuel supplied to the aspirator 12 decreases less than the amount of the fuel discharged from the fuel pump 11, the fuel intake valve 21 is opened again. Although one simple example of fuel supply control is shown in FIG. 4, it is preferred to control the fuel intake valve 21 such that the amount of the fuel led to the aspirator 12 is adequately increased or decreased depending on, e.g., the amount of the fuel supplied to the engine, instead of opening or closing the fuel intake valve 21 completely.

When the fuel pump 11 is stopped, the fuel intake valve 21 is closed, so that fuel supply to the aspirator 12 is inhibited while maintaining fuel pressure in the fuel supply pipe 4. In addition, the aspirator 12 is directed downwardly in the gas space, so that the fuel remaining in the aspirator 12 flows out. In this case, negative pressure is kept in the recovery pipe 3 and the canister 10, however, because the discharge opening 12*a* of the aspirator 12 is positioned in the gas space, the fuel F in the fuel tank 1 can be prevented from flowing back through the recovery pipe 3. When the fuel pump 11 is stopped, the air pipe valve 20 is opened again, and the recovery pipe valve 23 is closed.

Figure 5:
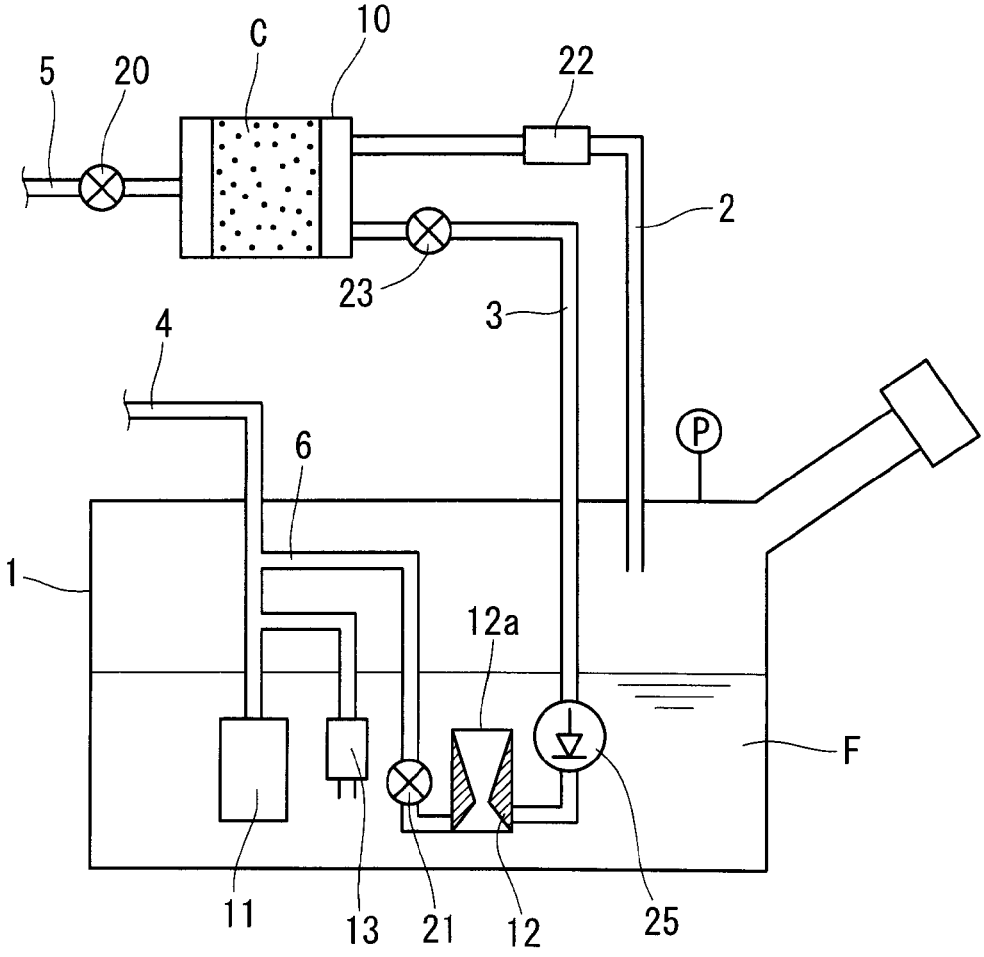
FIG. 5 is a schematic view showing another fuel vapor processor.

Although the aspirator 12 as the negative pressure generator is disposed in the gas space in the fuel tank 1 and the discharge opening 12*a* of the aspirator 12 for discharging the recovered fuel is positioned in the gas space in this configuration, the aspirator 12 can be submerged in the fuel F. With respect to FIG. 5 and FIG. 6, the aspirator 12 is submerged in the fuel F.

As described above, the fuel vapor processor shown in FIG. 5 has the aspirator 12 submerged in the fuel F inside the fuel tank 1. In addition, the discharge opening 12*a* of the aspirator 12 for discharging the recovered fuel is also submerged in the fuel F. This aspirator 12 is directed upwardly. When the aspirator 12 operates in the fuel, higher negative pressure is generated than that generated by the aspirator 12 in the gas space, thereby increasing the discharge amount of the recovered fuel. In this way, even if the same amount of the fuel is used, a recovery capacity for the fuel vapor of the aspirator 12 submerged in the fuel can be increased more than that of the aspirator 12 disposed in the gas space. In addition, because the aspirator 12 is directed upwardly, when the fuel pump 11 is stopped, the fuel F in the aspirator 12 would not flow out. Therefore, it is able to reduce a time difference between starting the fuel pump 11 and generation of the negative pressure, thereby improving responsiveness.

However, in the case that (the discharge opening 12*a* of) the aspirator 12 is submerged in the fuel, after stopping the fuel pump 11, there is a possibility that the fuel F in the fuel tank 1 flows back through the recovery pipe 3. If the fuel flows back into the canister 10, an ability of the canister to trap the fuel vapor drastically decreases. Hence, the fuel vapor processor of this embodiment has a check valve 25 as a backflow preventer for preventing the fuel F in the fuel tank 1 from flowing back through the recovery pipe 3 and reaching the canister 10. The check valve 25 is composed of a one-way check valve, such that the check valve 25 allows fluids to flow from the canister 10 toward the aspirator 12 and prevents fluids from flowing from the aspirator 12 toward the canister 10. Therefore, the check valve 25 is preferably disposed on the recovery pipe 3 and near the aspirator 12. Other configurations are same as those of the described above, so that corresponding members are labeled with the same reference numbers and will not be explained.

Figure 6:
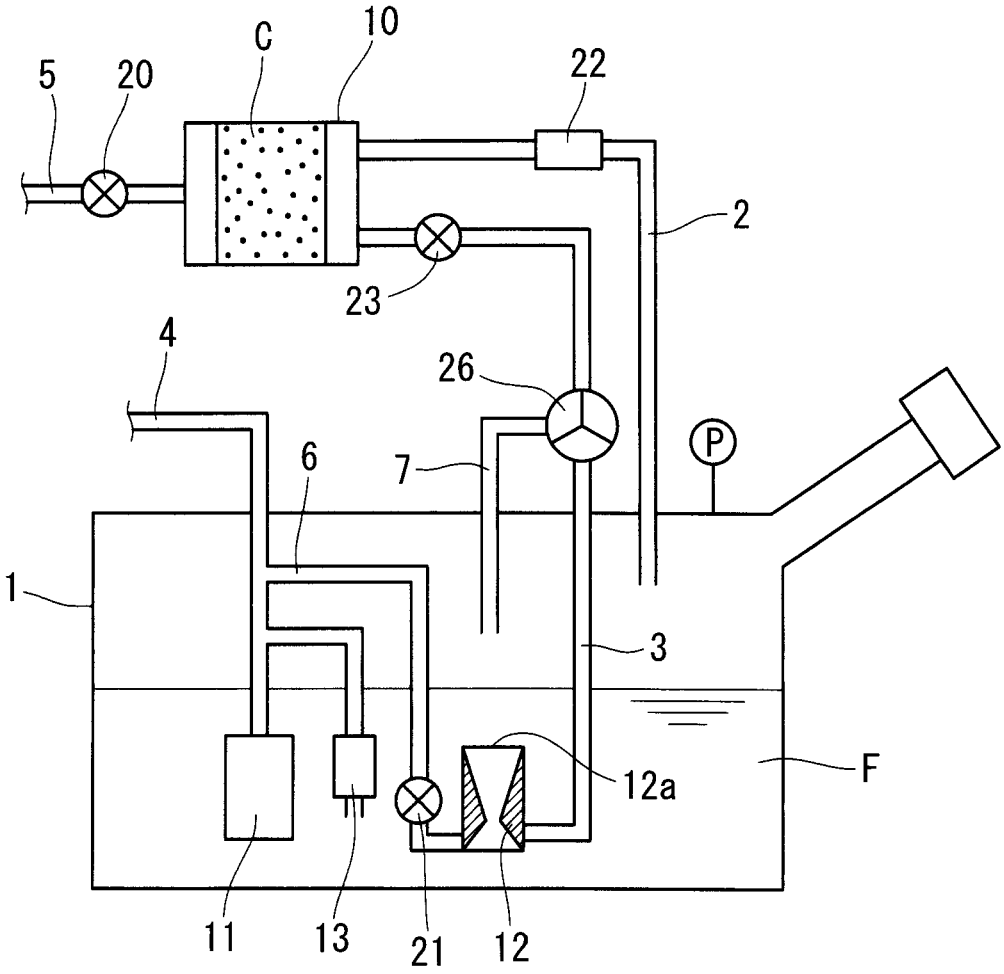
FIG. 6 is a schematic view showing another fuel vapor processor.

The fuel vapor processor shown in FIG. 6 has the discharge opening 12*a* of the aspirator 12 submerged in the fuel F. The configuration that the aspirator 12 is directed upwardly and effects due to this configuration are same as those of the fuel vapor processor shown in FIG. 5. This fuel vapor processor has a three-way valve 26 disposed on the recovery pipe 3 as the backflow preventer for preventing the fuel F reserved in the fuel tank 1 from flowing back through the recovery pipe 3 and reaching the canister 10 and a return pipe 7, which are fluidly communicated with the recovery pipe 3 via the three-way valve 26. The three-way valve 26 can adequately switch between a condition that the canister 10 and the aspirator 12 are fluidly communicated and another condition that the aspirator 12 and the return pipe 7 are fluidly communicated. And, switching timing of the three-way valve 26 is controlled by the ECU. An end of the return pipe 7, i.e., an outlet for the fuel, is positioned in the fuel tank 1.

As for this embodiment, the canister 10 and the aspirator 12 are communicated with each other via the three-way valve 26 while the fuel pump 11 is running. Thus, when the fuel pump 11 is stopped, the fuel F in the fuel tank 1 could flow back into the recovery pipe 3 via the aspirator 12. Therefore, the three-way valve 26 is switched in order to communicate the aspirator 12 with the return pipe 7 at the same time or just before stopping of the fuel pump 11. Because of this switching, the fuel F flowing back into the recovery pipe 3 due to stopping of the fuel pump 11 can return into the fuel tank 1 through the three-way valve 26 and the return pipe 7, or the recovery pipe 3, so that it is able to prevent the fuel F from flowing into the canister 10 certainly. Because other configurations are substantially same as those of the above-described embodiment, corresponding members are labeled with the same reference numbers and will not be explained.

Figure 7:
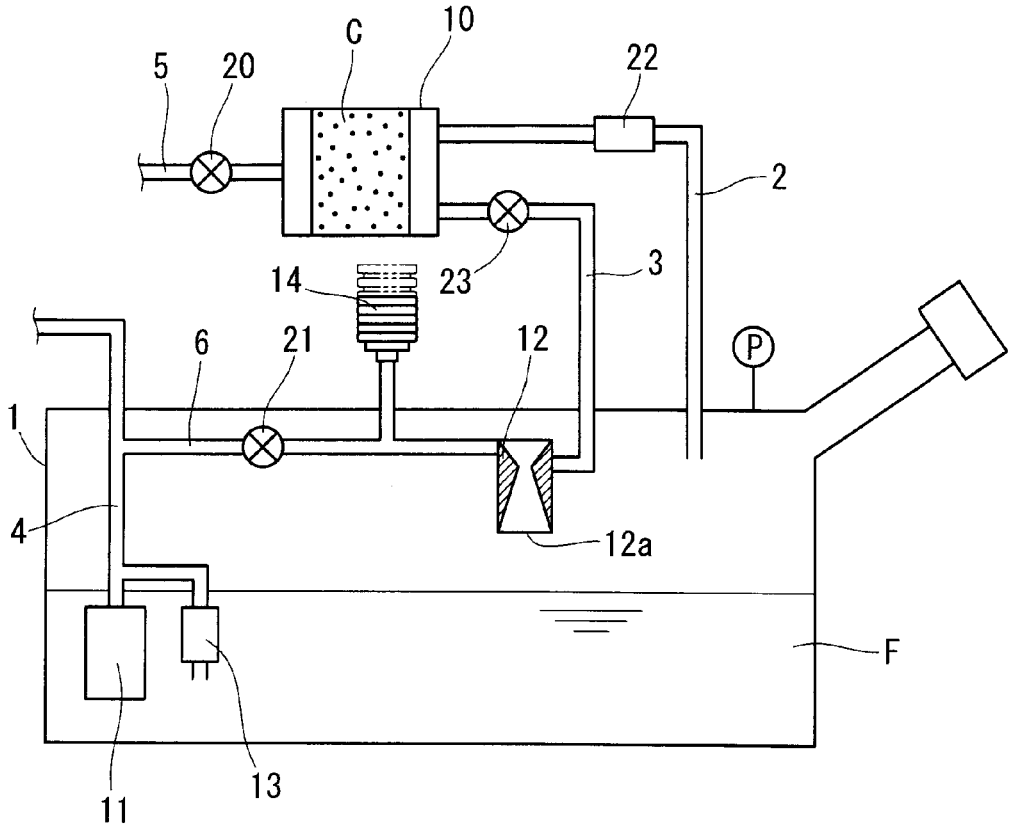
FIG. 7 is a schematic view showing another fuel vapor processor.

The fuel vapor processor shown in FIG. 7 is a variant of that shown in FIG. 2 and has a sub-tank 14 outside the fuel tank 1. The sub-tank 14 is communicated with the fuel intake pipe 6 between the fuel intake valve 21 and the aspirator 12 and can temporarily reserve some of the fuel F directed toward the aspirator 12 from the fuel pump 11. A peripheral wall of the sub-tank 14 is formed in a bellows shape, and thus the sub-tank 14 is expandable in order to alter an inner space of the sub-tank 14.

The sub-tank 14 is in a contracted state as shown in FIG. 7 during a normal condition where the fuel pump is not running. When the fuel F flows through the fuel intake pipe 6 due to working of the fuel pump 11, some of the fuel F flows into the sub-tank 14. Then, the sub-tank 14 expands as shown by a dot-line in FIG. 7 and reserves a certain amount of the fuel F. As a result, a level of the fuel F in the fuel tank 1 comes down, and the gas space increases by a volume of fuel reduction, so that increase of the inner pressure in the fuel tank 1 can be prevented. Because the sub-tank 14 is disposed outside the fuel tank 1, the gas space in the fuel tank 1 can be increased appropriately. When the fuel pump 11 is stopped again, the fuel F in the sub-tank 14 flows into the fuel tank 1 via the aspirator 12, and the sub-tank 14 contracts again. Other configurations are substantially same as those of the fuel vapor processor shown in FIG. 2, so that corresponding elements are labeled with the same reference numbers and will not be explained.

The above-described configurations have the fuel intake valve 21 and the aspirator 12 separately, however the fuel intake valve 21 and the aspirator 12 can be integrated, thereby minimizing the size of the processors. For example, an aspirator unit including the fuel intake valve 21 and the aspirator 12 can be disposed in a reservoir cup for housing a fuel pump unit. Another configuration including the aspirator unit housed in the reservoir cup will be explained.

Figure 8:
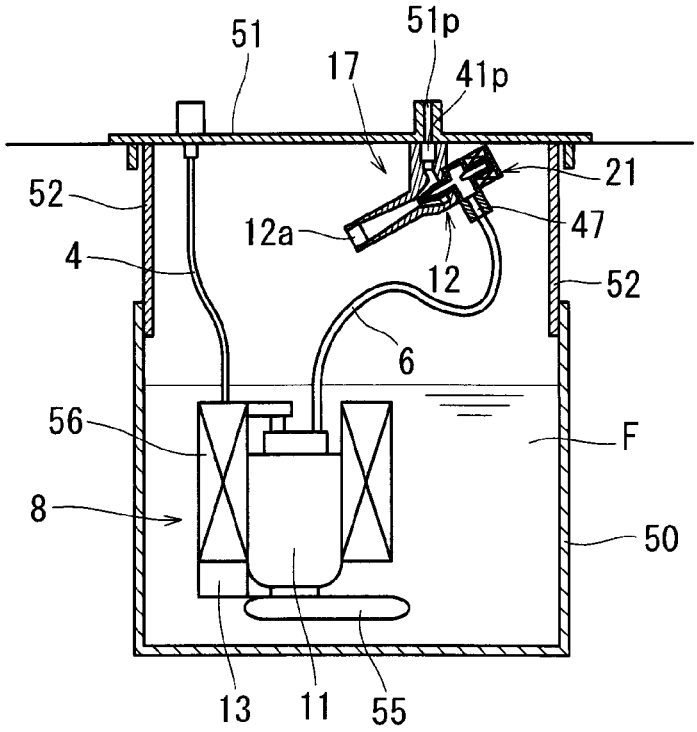
FIG. 8 is a cross-sectional view of a unit including the aspirator.

In a case that the aspirator 12 is provided in the gas space, the aspirator unit 17 can be disposed on a lower surface of a setting plate 51 of the reservoir cup 50 as shown in FIG. 8. In this case, the aspirator 12 is preferably directed downwardly. Shafts 52 connect the reservoir cup 50 with the setting plate 51 such that the reservoir cup 50 can move upwardly and downwardly relative to the setting plate 51. A fuel pump unit 8 housed in the reservoir cup 50 has the fuel pump 11, a suction filter 55 disposed on an inlet of the fuel pump 11, a filter 56 disposed on an outlet of the fuel pump 11 and surrounding the fuel pump 11, and the pressure regulator 13 for returning the excess fuel. The fuel F suctioned by the fuel pump 11 through the suction filter 55 is pumped into the fuel supply pipe 4 via the filter 56.

The aspirator unit 17 is fluidly communicated with the suction port 41*p* of the aspirator 12 and a suction port 51*p* penetrating the setting plate 51, and the recovery pipe 3 is connected with the suction port 51*p* on the setting plate 51. The aspirator 12 is directly communicated with the fuel tank 1 via the fuel intake pipe 6 connected with the fuel intake port 47. Detailed configurations of the aspirator unit 17 including the fuel intake valve 21 and the aspirator 12 will be described below.

Figure 9:
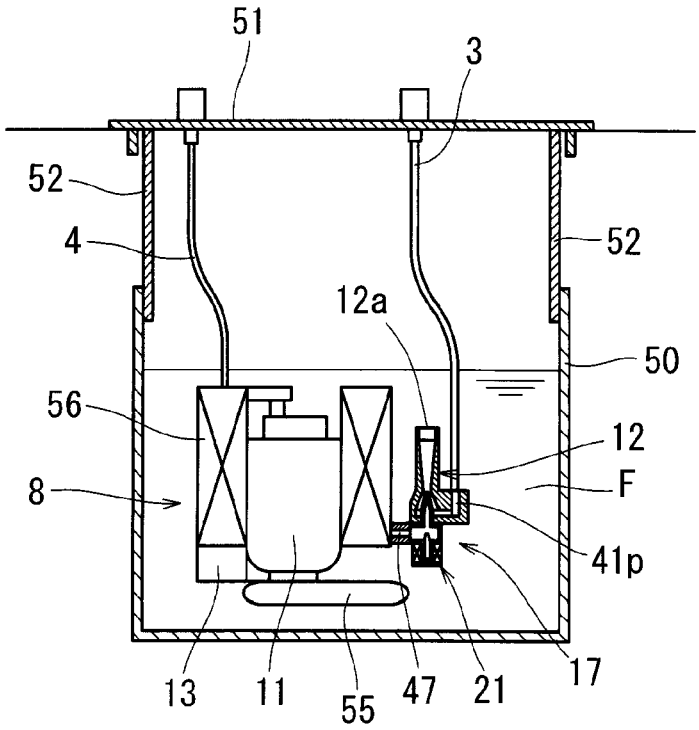
FIG. 9 is a cross-sectional view of another unit including the aspirator.

In a case that the aspirator 12 is submerged in the fuel F, the aspirator unit 17 can be directly mounted on the fuel pump unit 8, which should be submerged in the fuel F, as shown in FIG. 9. In particular, the aspirator unit 17 can be connected with a middle portion of the filter 56. In this case, the aspirator unit 17 can be considered as a component of the fuel pump unit 8. In addition, the fuel intake pipe 6 is not necessary or can be shortened drastically. In this case, the aspirator 12 is preferably directed upwardly.

Figure 10:
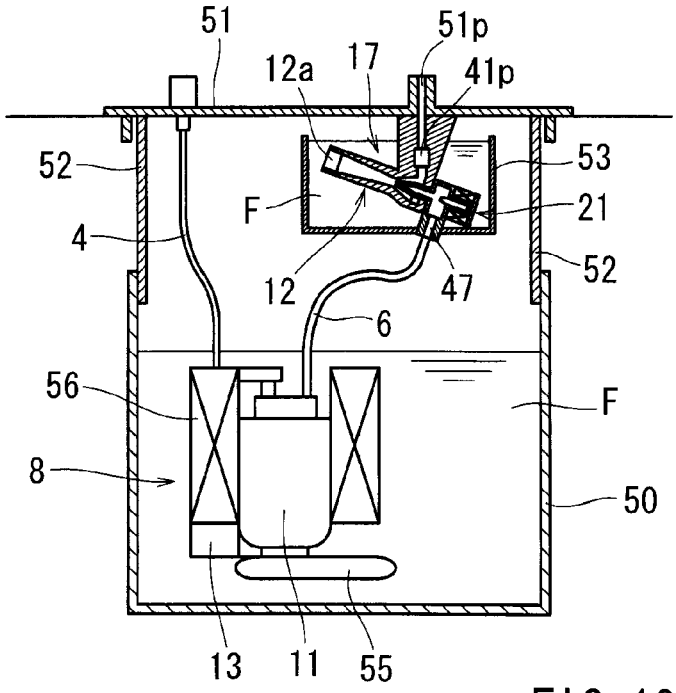
FIG. 10 is a cross-sectional view of another unit including the aspirator.

In the case that the aspirator 12 is submerged in the fuel F, the aspirator unit 17 can be disposed on the lower surface of the setting plate 51 as shown in FIG. 10. However, in this case, it is necessary to provide a sub-reservoir cup 53 near the lower surface of the setting plate 51 in order to submerge the aspirator 12. Thus, the fuel F is reserved in the sub-reservoir cup 53, so that the aspirator 12 can be submerged in the fuel F. The aspirator 12 is also preferably directed upwardly in this case.

Figure 11:
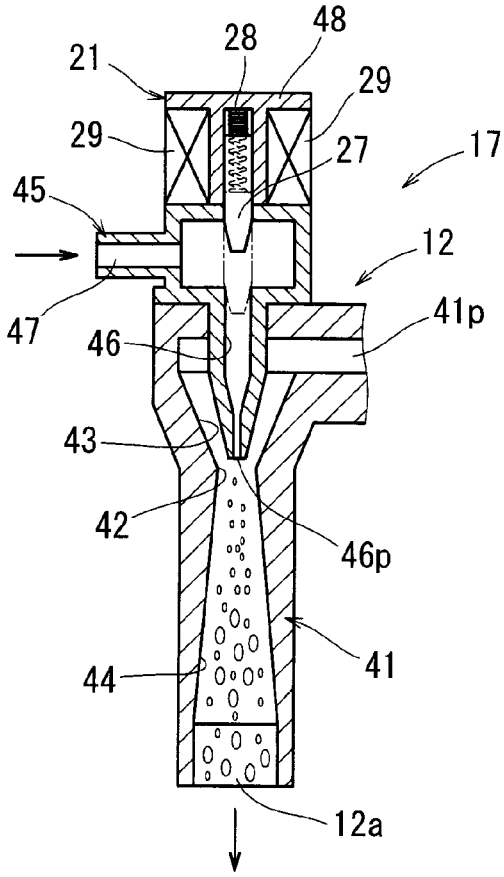
FIG. 11 is a longitudinal cross-sectional view of the aspirator.

Next, configurations of the unit including the aspirator 12 and the fuel intake valve 21 will be described based on FIG. 11. Each of the units shown in FIG. 8-10 has one of the suction ports 41*p* different from each other depending on their installation conditions, however their basic configurations are substantially same. Therefore, FIG. 11 shows the aspirator similar to that shown in FIG. 3. As shown in FIG. 11, the fuel intake valve 21 is integrated with an end portion of the aspirator 12 near the nozzle housing 45. In particular, the nozzle housing 45 is coupled with a valve mounted base 48, and a valve body 27 for opening and closing a flow passage in the nozzle body 46 is disposed at a central portion of the valve mounted base 48. The valve body 27 is formed in a pin shape and can slide in an axial direction of the aspirator 12. A compression spring 28 is provided between the valve body 27 and the valve mounted base 48, so that the valve body 27 is always biased in a valve closing direction (downwardly in FIG. 11) due to force exerted by the compression spring 28. In addition, electric magnets 29 are disposed at a periphery of the valve mounted base 48 such that the electric magnets 29 surround the valve body 27. When electricity is supplied to the electric magnets 29 due to the ECU control, the valve body 27 is moved in a valve opening direction (upwardly in FIG. 11), so that the flow passage in the nozzle body 46 is opened.

With respect to the fuel vapor processor described, the aspirator 12 as the negative pressure generator is directly communicated with the fuel pump 11, so that it is able to stably generate negative pressure not depending on the amount of the fuel returned from the pressure regulator 13. In addition, the fuel intake valve 21 is disposed on the fuel intake pipe 6, so that it is able to adequately control the amount of the fuel led into the aspirator 12 from the fuel pump 11 depending various circumferences. In particular, it is able to certainly prevent a shortage of the fuel supplied to the engine in a condition that the assumed total amount of the fuel requirement by the engine and the fuel led into the aspirator 12 is higher than a maximum amount of the fuel discharged from the fuel pump 11.

By using the recovery pipe valve 23 disposed on the recovery pipe 3 as the opening and closing device, it is able to control a recovery timing for the fuel vapor not depending on working of the aspirator 12 associated with the running of the fuel pump 11. In addition, in a case that the outlet for the fuel vapor recovered from the canister 10 is submerged in the fuel F, because the check valve 25 is provided, backflow of the fuel in the fuel tank 1 into the canister 10 after stopping the fuel pump 11 can be certainly prevented. Here, in a case that the outlet for the recovered fuel vapor is positioned in the gas space, when the liquefied recovered fuel is discharged from the outlet, there is a possibility that the fuel vaporizes again in the gas space. On the other hand, it is able to prevent such re-vaporization due to the configuration that the outlet for the recovered fuel vapor is submerged in the fuel F.

In a case that the sub-tank 14 capable of temporally reserving some of the fuel led into the aspirator 12 from the fuel pump 11 is provided, when the sub-tank 14 reserves the fuel, the amount of the fuel in the fuel tank 1 decreases. In this way, a volume of the gas space in the fuel tank 1 increases, so that it is able to prevent increase in the inner pressure of the fuel tank 1 during recovery of the fuel vapor from the canister 10. The sub-tank 14 is configured to expand and contract depending on the amount of the reserved fuel in order to minimize the size of the sub-tank 14. In addition, the sub-tank 14 is disposed outside the fuel tank 1, so that it is able to prevent increase of the inner pressure of the fuel tank 1. Furthermore, the fuel intake valve 21 can be integrated with the aspirator 12 in order to minimize the processor.

Some representative variants are described above, however other various modifications can be practiced. For example, the pressure control valve 22 disposed on the vapor pipe 2 can be composed of a solenoid valve controlled by the ECU like the recovery pipe valve 23. In this case, the pressure control valve 22 is closed in a normal condition, and is opened when the pressure sensor P detects the inner pressure in the fuel tank higher than the predetermined value.

Although the amount of the fuel directed to the aspirator 12 is regulated in the described embodiments, it is preferred that control of power distribution to the fuel pump 11 (demand control) is carried out and that discharge amount of the fuel pump 11 is also controlled by the ECU. Due to this configuration, it is able to determine a minimum fuel amount depending on the amount of the fuel supplied to the engine and the fuel led into the aspirator 12, thereby saving energy efficiently.

Furthermore, another pressure control valve can be disposed on the air pipe 5 between the canister 10 and the air pipe valve 20 in order to maintain negative pressure in the canister 10. A heater for heating adsorbent C can be provided in the canister 10. When the adsorbent C is heated by the heater during recovery of the fuel vapor, desorption efficiency of the fuel vapor is improved, thereby achieving higher recovery efficiency. A separator such as a separation membrane capable of separating the fuel vapor from contents of air can be disposed at a proper location in the fuel vapor processor such that dilution gas is circulated while the fuel vapor is concentrated and recovered. In addition, the sub-tank 14 can be applied to other embodiments.

Figure 12:
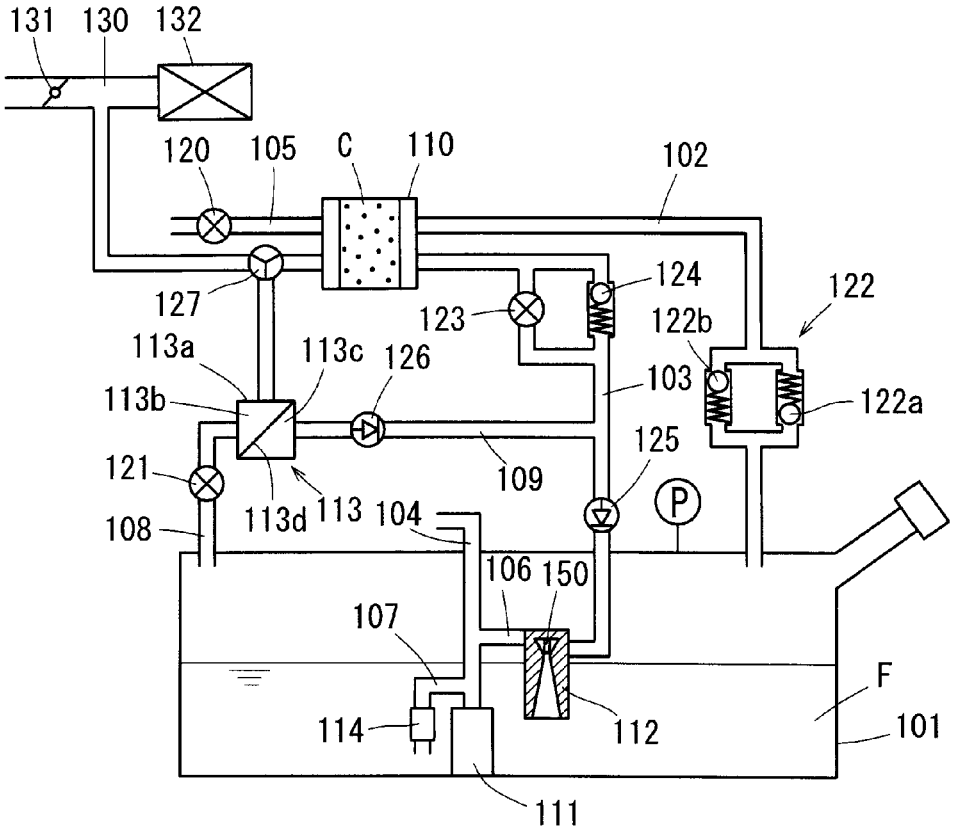
FIG. 12 is a schematic view showing another fuel vapor processor.

Another configuration will be described based on FIG. 12. The fuel vapor processor has a fuel tank 101 for reserving the fuel F, a fuel pump 111 for pumping the fuel F in the fuel tank 101 to an internal combustion (engine) not shown, a canister 110 for trapping the fuel vapor (for example, gasoline vapor) generated in the fuel tank 101, a first vapor pipe 102 for leading the fuel vapor in the fuel tank 101 to the canister 110, a first recovery pipe 103 for recovering the fuel vapor trapped in the canister 110 into the fuel tank 101, a pressure regulator 114 for returning some of the fuel F discharged from the fuel pump 111 into the fuel tank 101, and an aspirator 112 for generating negative pressure by utilizing some of the fuel F discharged from the fuel pump 111.

The fuel tank 101 is a sealed reservoir. The fuel pump 111 is disposed at a bottom of the fuel tank 101 and pumps the fuel F to the engine through a fuel supply pipe 104. The pump 111 is fluidly communicated with the pressure regulator 114 via a return pipe 107 branched from the fuel supply pipe 104. In addition, the fuel pump 111 is communicated with the aspirator 112 via a fuel intake pipe 106 branched from the fuel supply pipe 104. The fuel intake pipe 106 and the return pipe 107 are branched from the fuel supply pipe 104 independently. The fuel tank 101 has the pressure sensor P for detecting the inner pressure in the fuel, tank 101. Signals detected by the pressure sensor P are transmitted to an ECU (not shown). The ECU includes a central processing unit (CPU), a read-only memory (ROM), a random access memory (RAM) and the like. The ROM stores a specific control program, and the CPU timely controls each component based on the control program.

A pressure control valve 122 for keeping inner pressures in the fuel tank 101 and the canister 110 within a predetermined range is provided on the first vapor pipe 102. The pressure control valve 122 is a bi-directional check valve having a positive pressure valve 122*a* and a negative pressure valve 122*b*. The pressure control valve 122 is closed in a normal condition. When the inner pressure in the fuel tank 101 is higher than a predetermined value, the positive pressure valve 122*a* is opened, whereas when the inner pressure in the fuel tank 101 is lower than a predetermined value, the negative pressure valve 122*b* is opened. Setting pressure for the pressure control valve 122 is determined so as to prevent breakage of the fuel tank 101, hence, for example, the setting pressure is set at about ±5 kPa. In this case, the inner pressure in the fuel tank 101 is kept in a range between about −5 kPa and about +5 kPa. The canister 110 and the aspirator 112 are connected via the first recovery pipe 103. The first recovery pipe 103 is equipped with a recovery pipe valve 123 as an opening and closing device for switching an open state and a closed state of the first recovery pipe 103. The recovery pipe valve 123 is a solenoid valve controlled by the ECU. In addition, the first recovery pipe 103 is equipped with a pressure control valve 124 parallel to the recovery pipe valve 123. The pressure control valve 124 is a check valve, which is opened when pressure in the recovery pipe 103 is lower than a predetermined value (i.e., negative pressure). Furthermore, the recovery pipe 103 is equipped with a check valve 125 for preventing backflow of the fuel from the aspirator 112 to the canister 110.

The canister 110 is a sealed container and is filled with the adsorbent C made of activated carbon or the like capable of adsorbing and desorbing the fuel vapor. The fuel vapor led into the canister 110 adsorbs onto the adsorbent C, on the other hand, the contents of air are not trapped by the adsorbent C. In addition, the canister 110 is fluidly communicated with an air pipe 105 having an end opening to the atmosphere. The air pipe 105 is also equipped with an air pipe valve 120 as an opening and closing device for switching an open state and a closed state of the air pipe 105. The air pipe valve 120 is also a solenoid valve controlled by the ECU.

The fuel tank 101 is connected with a second vapor pipe 108, which gas in the fuel tank 101 including fuel vapor vaporizing during recovery operation for the fuel vapor is led into. An end of the second vapor pipe 108 is connected with a separation membrane module 113 for separating specific components. The separation membrane module 113 is composed of a sealed container 113*a* and a separation membrane 113*d* disposed to divide an inner space of the sealed container 113*a* into an intake chamber 113*b* and a transmission chamber 113*c*. The separation membrane 113*d* of this embodiment is composed of a separation membrane with high dissolution dilution coefficient for the fuel components, which the fuel components can pass through whereas most of the air components cannot pass through. Therefore, the specific components of this embodiment correspond to the fuel components. The second vapor pipe 108 is connected with the intake chamber 113*b* of the separation membrane module 113. The transmission chamber 113*c* is communicated with the first recovery pipe 103 via a second recovery pipe 109. The second vapor pipe 108 is equipped with a second vapor pipe valve 121 composed of a solenoid valve controlled by the ECU as an opening and closing device for switching an open state and a closed state of the second vapor pipe 108. The second recovery pipe 109 is equipped with a check valve 126 for preventing backflow of the fuel from the aspirator 112 to the separation membrane module 113. The intake chamber 113*b* of the separation membrane module 113 is selectively communicated with the canister 110 or an air induction pipe 130 via a three-way valve 127. The three-way valve 127 is controlled by the ECU. The air induction pipe 130 is a pathway for providing air to the engine. The air induction pipe 130 has a throttle valve 131 for regulating intake airflow and an air filter 132.

Figure 13:
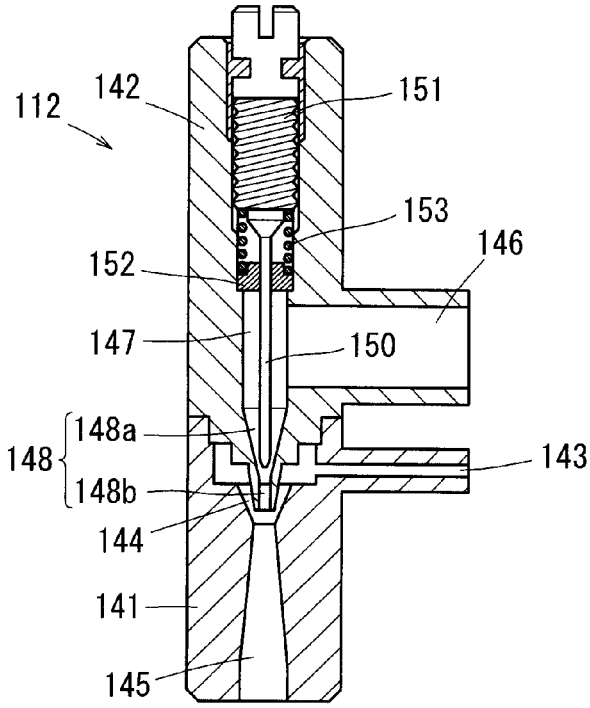
FIG. 13 is a longitudinal cross-sectional view of another aspirator.

The aspirator 112 is composed of a venturi housing 141 and a nozzle housing 142 as shown in FIG. 13. The venturi housing 141 is provided with a suction port 143 connected with the first recovery pipe 103 for suctioning the fuel vapor. A venturi portion 144 and a diffuser portion 145 are formed sequentially in an axial direction of the aspirator 112 (vertical direction in FIG. 13) in the venturi housing 141. The suction port 143 is fluidly communicated with the venturi portion 144. The venturi portion 144 and the diffuser portion 145 are formed concentrically, and an end of the diffuser portion 145 is an outlet of the aspirator 112. The venturi portion 144 has a diameter gradually decreasing along a flowing direction of the fuel vapor. On the other hand, the diffuser portion 145 has a diameter gradually increasing along the flowing direction of the fuel vapor. Therefore, a connection portion between the venturi portion 144 and the diffuser portion 145 is the narrowest. In addition, the diffuser portion 145 has a cylindrical section parallel to the axis of the aspirator 112 near its lower end.

The nozzle housing 142 has an intake port 146, which some of the fuel discharged from the fuel pump 111 is led into and which is connected with the fuel intake pipe 106. The intake port 146 as a primary port of the aspirator 112 has a larger diameter than the suction port 143 as a secondary port of the aspirator 112. In addition, a fuel passage 147 and a nozzle portion 148 are formed concentrically and sequentially in the fuel flowing direction in the nozzle housing 142. The fuel passage 147 is communicated with the intake port 146 and extends in the axial direction of the aspirator 112. The nozzle portion 148 has a tapered section 148*a* whose diameter gradually decreases downwardly and an injection section 148*b* having smaller diameter than the fuel passage 147. The nozzle housing 142 is disposed on the venturi housing 141 concentrically. The injection section 148*b* of the nozzle portion 148 is located in the venturi portion 144.

A needle valve 150 in a needle shape is provided in the nozzle housing 142 of the aspirator 112. The needle valve 150 can be moved in the axial direction of the aspirator 112 in order to regulate the amount of the fuel injected from the nozzle portion 148 depending on a position of the needle valve 150. The needle valve 150 is located in the fuel passage 147 and the nozzle portion 148, and an end of the needle valve 150 is located near the injection section 148*b*. An outer diameter of the needle valve 150 is slightly smaller than an inner diameter of the injection section 148*b*. A base end of the needle valve 150 is coupled with an adjust screw 151 threadably mounted on the nozzle housing 142 at upstream of the fuel passage 147. The end of the needle valve 150 can be moved in the axial direction by altering the position of the adjust screw 151. The needle valve 150 can be moved such that the end of the needle valve 150 goes into the injection section 148*b*. The nozzle housing 142 has a sealing member 152 and a support spring 153 for biasing the sealing member 152.

When the fuel F is led into the aspirator 112 from the intake port 146, the fuel F flows through the fuel passage 147 and is injected from the injection section 148*b* of the nozzle portion 148 into the venturi portion 144 of the venturi housing 141. Then, the injected fuel F moves from the venturi portion 144 toward the diffuser portion 145 in the axial direction at high speed. Thus, negative pressure is generated in the venturi portion 144, so that the fuel vapor is suctioned from the suction port 143. Here, strength of the negative pressure generated in the venturi portion 144 varies depending on the amount of the fuel injected from the nozzle portion 148. An opening ratio of the nozzle portion 148 can be changed by altering the position of the needle valve 150 relative to the nozzle portion 148, thereby adequately adjusting the strength of the negative pressure generated by the aspirator 112, i.e., suction capability. The fuel vapor suctioned due to the negative pressure is mixed with the fuel F in the venturi portion 144 and is discharged from the diffuser portion 145. It is preferred that the position of the adjust screw 151 can be changed due to operation outside the fuel tank 101 (preferably, in an engine room).

Next, processing mechanism by the fuel vapor processor having the above-described configuration will be described. The air pipe valve 120 on the air pipe 105 is open in a normal condition (off condition). Whereas, the recovery pipe valve 123 on the first recovery pipe 103 and the second vapor pipe valve 121 on the second vapor pipe 108 are closed in the normal condition. In addition, the three-way valve 127 usually communicates the separation membrane module 113 with the canister 110. In a state that the fuel pump 111 is not running, for example, during parking or refueling, when the inner pressure in the fuel tank 101 is higher than the setting pressure for the pressure control valve 122 due to generation of the fuel vapor or increase of the fuel, the positive pressure valve 122*a* of the pressure control valve 122 is opened, so that gas including air and the fuel vapor in the fuel tank 101 flows into the canister 110 through the vapor pipe 102. Then, the fuel vapor selectively adsorbs onto the adsorbent C in the canister 110. Remaining air passes through the canister 10 filled with the adsorbent C and flows into the atmosphere through the air pipe 105, so that pressure in the fuel tank 101 can be reduced. Thus, a drastic increase in the inner pressure of the fuel tank 101 is prevented while avoiding air pollution in order to prevent breakage of the fuel tank 101. When the inner pressure in the fuel tank 101 is within a range of the setting pressure for the pressure control valve 122, the pressure control valve 122 is closed, so that the fuel tank 101 is hermetically closed. On the other hand, when the inner pressure of the fuel tank 101 decreases below the setting pressure for the pressure control valve 122 due to temperature decrease or the like, the negative pressure valve 122*b* of the pressure control valve 122 is opened in order to make ambient air flow into the fuel tank 101 through the air pipe 105, the canister 110, and the first vapor pipe 102. In this way, a drastic decrease in the inner pressure of the fuel tank 101 is inhibited in order to prevent breakage of the fuel tank 101.

While the fuel pump 111 is running during driving or the like, the air pipe valve 120 is closed and the first recovery pipe valve 123 is opened. Some of the fuel F discharged from the fuel pump 111 is returned from the pressure regulator 114 into the fuel tank 101 via the return pipe 107. Thus, pressure of the fuel supplied to the engine in the fuel supply pipe 104 is regulated. The amount of the fuel returned by the pressure regulator 114 in this embodiment corresponds to an amount required for minimum control of the fuel pressure. In addition, some of the fuel F discharged from the fuel pump 111 is led into the aspirator 112 from the fuel supply pipe 104 through the fuel intake pipe 106. Thus, the aspirator 112 generates negative pressure, so that the fuel vapor trapped in the canister 110 is desorbed and is recovered into the fuel tank 101 through the recovery pipe 103 and the aspirator 112. At this time, the negative pressure in the canister 110 is kept due to the pressure control valve 122. Here, the amount of the fuel led into the aspirator 112 (the fuel injected from the nozzle portion 148), i.e., the suction capability of the aspirator 112 can be altered during assembling or parking (before driving) depending on car models, seasons, area, kind of the fuel or the like.

While the fuel pump 111 is running, the second vapor pipe valve 121 is opened. Thus, the gas in the fuel tank 101 including the fuel vapor vaporizing during recovery operation of the fuel vapor is led into the separation membrane module 113 through the second vapor pipe 108. When the gas in the fuel tank 101 is led into the intake chamber 113*b* of the separation membrane module 113, the components of the fuel pass through the separation membrane 113*d*. In this way, the fuel vapor in the transmission chamber 113*c* is separated from the components of the air remaining intake chamber 113*b*. The fuel vapor (concentrated gas) in the transmission chamber 113*c* is recovered through the second recovery pipe 109, the first recovery pipe 103 and the aspirator 112 and then into the fuel tank 101. Whereas, the remaining air (diluted gas) in the intake chamber 113*b* is led into the canister 110 via the three-way valve 127 and is utilized for desorbing the fuel vapor from the adsorbent C. Here, negative pressure in the second recovery pipe 109 and the transmission chamber 113*c* of the separation membrane module 113 are kept due to working of the pressure control valve 124, so that there is a differential pressure between in the intake chamber 113*b* and in the transmission chamber 113*c* across the separation membrane 113*d*. Such differential pressure increases an efficiency of separation of the fuel vapor.

In this way, in a normal recovery operation of the fuel vapor, the air pipe valve 120 on the air pipe 105 is closed, and the separation membrane module 113 and the canister 110 are fluidly communicated with each other via the three-way valve 127, so that the fuel vapor processor is hermetically closed. However, when ambient temperature is high or when high amount of fuel vapor is generated due to high temperature of the fuel F caused by heat emitted from the engine or fuel pump 111 or the like, the inner pressure of the fuel tank 101 could drastically increase. In such case, when the pressure sensor P detects the inner pressure of the fuel tank 101 higher than the predetermined value (for example, setting pressure for the pressure control valve 122), the three-way valve 127 is switched such that the separation membrane module 113 is fluidly communicated with the air induction pipe 130 in order to reduce the inner pressure. Therefore, it is able to prevent a drastic increase of the pressure inside the fuel tank 101. When the detected pressure by the pressure sensor P decreases below the predetermined value, the three-way valve 127 is switched such that the separation membrane module 113 and the canister 110 are fluidly communicated with each other.

When the fuel pump 111 is stopped, the air pipe 120 is opened, and the first recovery valve 123 and the second vapor pipe valve 121 are closed. Just after stopping the fuel pump 111, the fuel F could potentially flow back from the aspirator 112, however the check valves 125 and 126 prevent backflow of the fuel F into the canister 110 and the separation membrane module 113.

Figure 14:
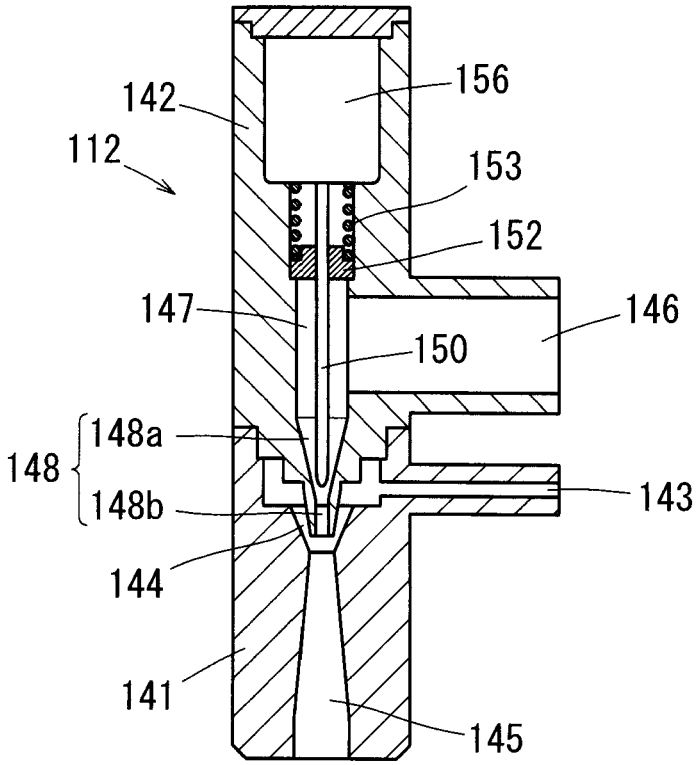
FIG. 14 is a longitudinal cross-sectional view of another aspirator.

Although the amount of the fuel F suctioned by the aspirator 112 is adjusted by manual control of the adjust screw 151 in the described embodiment, such amount can be adjusted due to feedback control by the ECU. In this case, as shown in FIG. 14, an actuator 156 capable of altering the position of the needle valve 150 can be provided in the aspirator 112 and can be connected with the base end of the needle valve 150. Here, the actuator 156 is equipped with a current-carrying mechanism not shown in FIG. 14. For example, a step motor equipped with a screw mechanism or an electric actuator such as a linear solenoid can be used for the actuator 156.

In this case, the ROM of the ECU stores a fuel supply map for the aspirator depending on the fuel consumption of the engine, engine load or characteristics of the fuel vapor. The actuator 156 is controlled with feedback based on the fuel supply map, so that the position of the needle valve 150 is changed to an optimum position depending on requirements by the system or alteration of fuel temperature. Thus, the amount of the fuel injected from the nozzle portion 148 can be controlled as needed. Due to this configuration, it is able to save trouble of manually controlling the amount of the fuel injected from the nozzle portion 148. In addition, the needle valve 150 can be moved to the optimum position depending on the engine load or alteration of the fuel temperature as needed, so that it is able to ensure a stable suction capability while avoiding shortage of the fuel supplied to the engine. Other configurations are substantially same as those of the described above, and thus the corresponding elements are labeled with the same reference numbers, respectively, and will not be explained.

The pressure control valve 122 on the first vapor pipe 102 can be composed of a solenoid valve controlled by the ECU like the first recovery pipe valve 123. In this case, the pressure control valve 122 is closed in a normal state. When the pressure sensor P detects the inner pressure of the fuel tank 101 higher than the predetermined value, the pressure valve 122 is opened.

The second vapor pipe 108, the second recovery pipe 109, the separation membrane module 113, the three-way valve 127 and the pressure control valve 124 are not indispensable. When the pressure sensor P detects the inner pressure of the fuel tank 101 higher than the predetermined value during recovery of the fuel vapor, the air pipe valve 120 can be opened in order to decrease the inner pressure.

In addition, a device for heating the adsorbent C such as a heater can be provided in the canister 110. Heating the adsorbent C due to working of the heating device during recovery of the fuel vapor can improve the desorption efficiency, so that recovery efficiency for the fuel vapor can be improved.

In accordance with the above-described embodiments, the amount of the fuel injected from the nozzle portion 148 can be changed depending on specific requirements based on engine displacement, car model or the like, so that it is no need to provide various aspirators depending on each vehicle. For example, in a case that the aspirator 112 is mounted on a vehicle having relatively large engine displacement, the needle valve 150 can be moved such that the opening ratio of the nozzle portion 148 is decreased in order to reduce the amount of the fuel injected from the nozzle portion 148. On the other hand, in a case that the aspirator 112 is mounted on a vehicle having relatively small engine displacement, the opening ratio of the nozzle portion 148 can be increased in order to increase the amount of the fuel injected from the nozzle portion 148. In addition, the amount of the fuel injected from the nozzle portion 148 can be adjusted depending on characteristics of the used fuel.

Furthermore, the amount of the fuel injected from the nozzle portion 148 can be controlled as needed depending on the fuel temperature, the engine load or the like, thereby ensuring a stable suction capability. For example, the amount of the fuel injected from the nozzle portion 148 can be increased as the fuel temperature increases, whereas the amount of the fuel injected from the nozzle portion 148 can be decreased as the fuel temperature decreases. In addition, in a case that the amount of the injected fuel, i.e., the amount of the fuel led into the aspirator 112 can be changed based on the engine load, if the engine requires a high amount of the fuel, it is able to prevent shortage of the fuel supplied to the engine.

This invention claims:

1. A fuel vapor processor comprising:

a fuel tank;

a canister for trapping fuel vapor generated in the fuel tank;

a vapor pipe for leading the fuel vapor from the fuel tank into the canister;

a recovery pipe for recovering the fuel vapor trapped in the canister into the fuel tank;

a fuel pump provided in the fuel tank;

a negative pressure generator for generating negative pressure depending on an amount of fuel supplied to the negative pressure generator from the fuel pump, where the fuel vapor trapped in the canister is recovered through the recovery pipe into the fuel tank due to the negative pressure;

a pressure regulator connected with the fuel pump for returning excess fuel discharged from the fuel pump into the fuel tank;

a fuel intake pipe for directly connecting the negative pressure generator with the fuel pump; and a fuel intake regulator disposed on the fuel intake pipe for controlling the amount of the fuel supplied to the negative pressure generator from the fuel pump.

2. The fuel vapor processor according to claim 1 further comprising:

an opening and closing device disposed on the recovery pipe for switching between an open state and a closed state of the recovery pipe.

3. The fuel vapor processor according to claim 1 further comprising:

a check valve disposed on the recovery pipe for preventing the fuel reserved in the fuel tank from flowing through the recovery pipe, wherein the recovery pipe comprises an outlet for the fuel vapor recovered from the canister, and the outlet is submerged into the fuel reserved in the fuel tank.

4. The fuel vapor processor according to claim 1 further comprising:

a sub-tank disposed outside the fuel tank, fluidly communicating with the fuel intake pipe between the fuel intake regulator and the negative pressure generator and being expandable when temporally reserving the fuel flowing through the fuel intake pipe toward the negative pressure generator.

5. The fuel vapor processor according to claim 1, wherein the fuel intake regulator is integrated with the negative pressure generator.

6. The fuel vapor processor according to claim 1, wherein the negative pressure generator is composed of an aspirator comprising:

a fuel intake port into which the fuel discharged from the fuel pump is led;

a nozzle portion for injecting the fuel led through the fuel intake port;

a suction port for suctioning the fuel vapor due to injection of the fuel from the nozzle portion;

a diffuser portion having an inner space where the fuel injected from the nozzle portion and the fuel vapor suctioned via the suction port are mixed with each other; and a needle valve movable in an axial direction of the aspirator and capable of adjusting the amount of the fuel injected from the nozzle portion depending on a position of the needle valve in the axial direction.

7. The fuel vapor processor according to claim 6, wherein the aspirator is composed of a housing and an adjust screw threaded into the housing, and the adjust screw is coupled with the needle valve such that the position of the needle valve can be changed due to displacement of the adjust screw.

8. The fuel vapor processor according to claim 6, wherein the aspirator includes an actuator coupled with the needle valve for altering the position of the needle valve.

* * * * *